US012023540B2

(12) United States Patent
Thomas et al.

(10) Patent No.: US 12,023,540 B2
(45) Date of Patent: Jul. 2, 2024

(54) PAIR OF CLOTHING BOTTOMS WITH ATTACHABLE WEIGHTS

(71) Applicants: Kurt Thomas, Frisco, TX (US); Rebecca Thomas, Frisco, TX (US)

(72) Inventors: Kurt Thomas, Frisco, TX (US); Rebecca Thomas, Frisco, TX (US)

( * ) Notice: Subject to any disclaimer, the term of this patent is extended or adjusted under 35 U.S.C. 154(b) by 0 days.

(21) Appl. No.: 17/397,963

(22) Filed: Aug. 9, 2021

(65) Prior Publication Data

US 2022/0040518 A1 Feb. 10, 2022

Related U.S. Application Data

(60) Provisional application No. 63/063,092, filed on Aug. 7, 2020.

(51) Int. Cl.

| | |
|---|---|
| ***A63B 21/065*** | (2006.01) |
| ***A41D 1/06*** | (2006.01) |
| ***A63B 21/00*** | (2006.01) |

(52) U.S. Cl.

CPC ..... *A63B 21/065* (2013.01); *A41D 1/06* (2013.01); *A63B 21/4011* (2015.10)

(58) Field of Classification Search

CPC ..... A63B 21/065; A63B 21/4011; A41D 13/0015; A41D 1/06; A41D 13/0562

See application file for complete search history.

(56) References Cited

U.S. PATENT DOCUMENTS

| | | | | |
|---|---|---|---|---|
| 2,035,604 | A * | 3/1936 | Ide | A41B 9/02 602/67 |
| 2,489,083 | A * | 11/1949 | Dubin | A41D 1/08 2/237 |
| 5,010,596 | A * | 4/1991 | Brown | A63B 21/065 2/238 |
| 5,075,902 | A * | 12/1991 | McReynolds | A63B 21/065 2/238 |
| 7,090,558 | B2 * | 8/2006 | Ott | A41C 3/0057 2/69 |
| 2006/0059609 | A1 * | 3/2006 | Moss | A41D 13/0506 2/455 |
| 2011/0247127 | A1 * | 10/2011 | Pou | A41D 13/0012 2/338 |

(Continued)

OTHER PUBLICATIONS

Taylor Ryan Inc, Weighted Shorts for Women, taylorryaninc.com, Jan. 2020.

(Continued)

*Primary Examiner* — Sally Haden
*Assistant Examiner* — Grady Alexander Nunnery

(57) ABSTRACT

A pair of clothing bottoms with attachable weights is provided to intensify a workout. The pair of clothing bottoms with attachable weights includes a pair of clothing bottoms, at least one left weight assembly, and at least one right weight assembly. The pair of clothing bottoms may be any type of athletic garments such as, but not limited to, a pair of shorts, a pair of leggings, or a pair of sweatpants. The at least one left weight assembly allows weights to be selectively attached to the pair of clothing bottoms to increase the load to the left hip side of a user during a workout. Similarly, the at least one right weight assembly allows weights to be attached to the pair of clothing bottoms to increase the load to the right hip side of the user during a workout.

11 Claims, 6 Drawing Sheets

(56) References Cited

U.S. PATENT DOCUMENTS

2015/0264984 A1* 9/2015 Dolcetti ..... A41D 13/0015
2/455

OTHER PUBLICATIONS

Titin, Hyper Gravity Weighted Compression ForceTM Shorts System, amazon.com, Apr. 2015.
Weighted Training Shorts, hoopsking.com, Dec. 2019.

* cited by examiner

PAIR OF CLOTHING BOTTOMS WITH ATTACHABLE WEIGHTS

The current application claims a priority to the U.S. Provisional Patent application Ser. No. 63/063,092 filed on Aug. 7, 2020. The current application is filed on Aug. 9, 2021, while Aug. 7, 2021 was on a weekend.

FIELD OF THE INVENTION

The present invention generally relates to athletic clothing and exercise equipment. More specifically, the present invention provides a pair of clothing bottoms with attachable weights for a more intensive workout.

BACKGROUND OF THE INVENTION

Exercise is a key part for a healthy lifestyle. There are multiple forms of exercise including, but not limited to, weightlifting, playing sports, and running. When exercising, individuals tend to wear athletic garments such as, but not limited to, shorts, leggings, or sweatpants. These garments allow for flexibility and provide breathable material to cool the individual during a workout. Additionally, when exercising, individuals use weights to intensify a workout. There are limitations when using weights. One limitation is that using weights requires the individual to use one or more hands in order to carry the weight during a workout. There are methods that allow weights to be attached to the body parts of an individual to overcome this issue. However, current methods do not combine weights with athletic garments in order to intensify a workout.

It is therefore an objective of the present invention to provide a pair of clothing bottoms with attachable weights in order to intensify a workout. The pair of clothing bottoms includes a fastener system that enables the attachment of weights adjacent to the hip areas. In addition, the weights are provided in a detachable patch equipped with fasteners to secure the weights to the pair of clothing bottoms. Furthermore, the weights are arranged in a bead channeled system to facilitate active movement of the user.

DETAILED DESCRIPTION OF THE INVENTION

All illustrations of the drawings are for the purpose of describing selected versions of the present invention and are not intended to limit the scope of the present invention.

Figure 1:
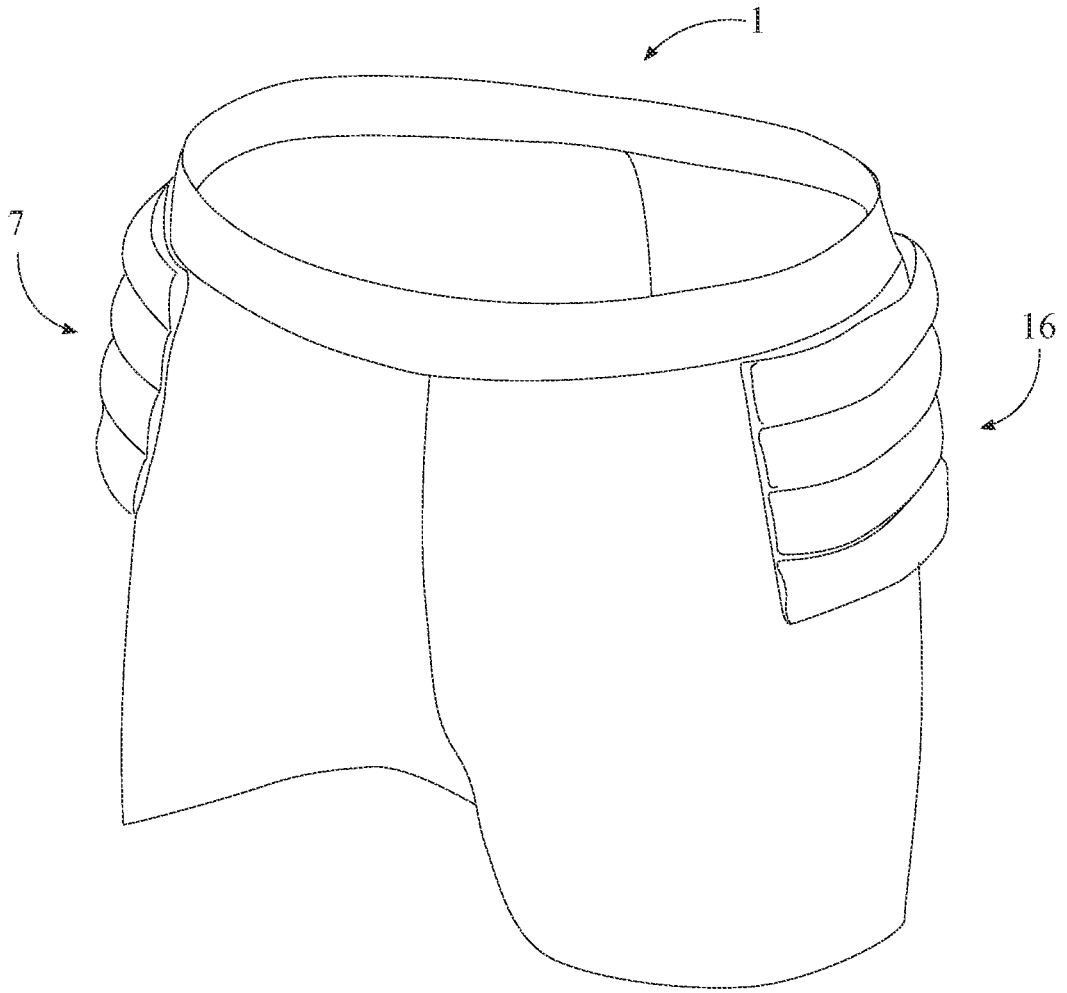
FIG. 1 is a front perspective view of the present invention.

In reference to FIGS. 1 through 6, the present invention is a pair of clothing bottoms with attachable weights in order to intensify a workout. With reference to FIG. 1, the present invention comprises a pair of clothing bottoms 1, at least one left weight assembly 7, and at least one right weight assembly 16. The pair of clothing bottoms 1 may be any type of athletic garments such as, but not limited to, a pair of shorts, a pair of leggings, or a pair of sweatpants. The at least one left weight assembly 7 allows weights to be selectively attached to the pair of clothing bottoms 1 to increase the load to the left hip side of a user during a workout. Similarly, the at least one right weight assembly 16 allows weights to be attached to the pair of clothing bottoms 1 to increase the load to the right hip side of the user during a workout.

Figure 2:
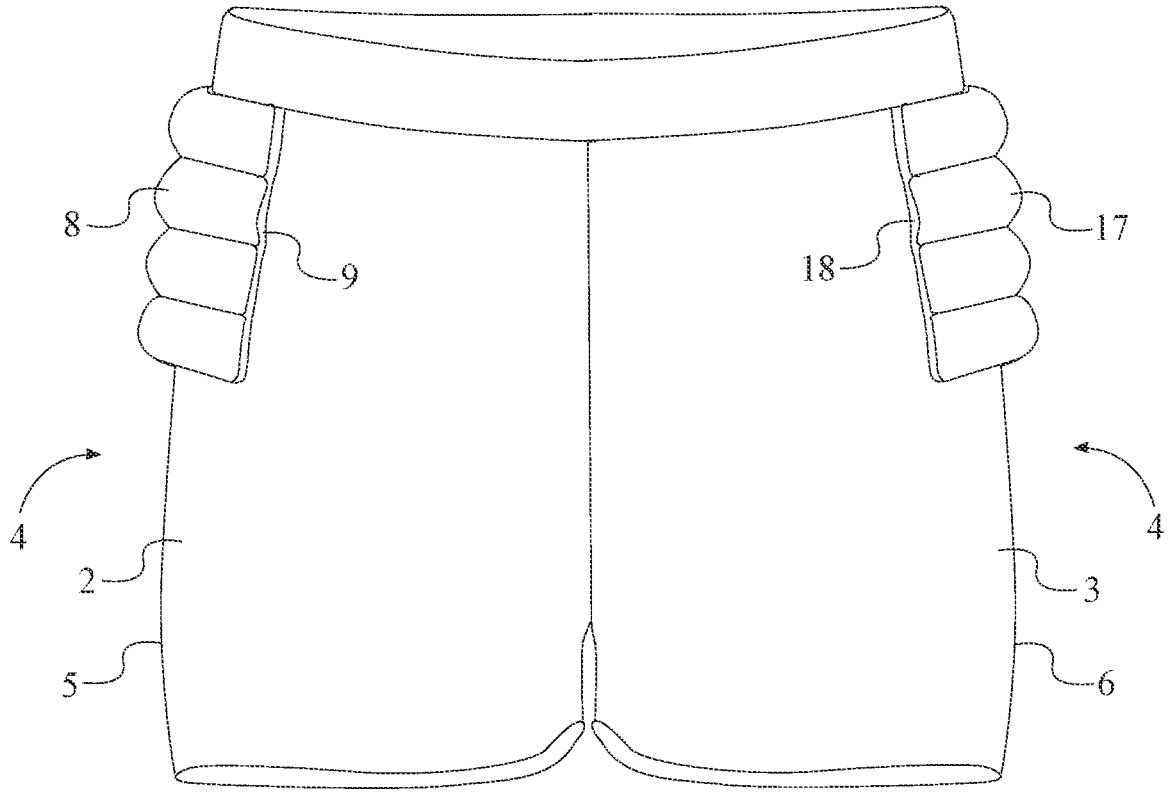
FIG. 2 is a front view of the present invention.

The general configuration of the aforementioned components allows the present invention to intensify a workout. With reference to FIG. 2, the pair of clothing bottoms 1 comprises a left leg portion 2 and a right leg portion 3 which are respectively used to cover the left leg and the right leg of the user. The at least one left weight assembly 7 comprises a left weight body 8 and a left support patch 9. Similarly, the at least one right weight assembly 16 comprises a right weight body 17 and a right support patch 18. The left weight body 8 and the right weight body 17 each is preferably a pouch filled with a plurality of weighted beads. However, the left weight body 8 and the right weight body 17 may be various types of weighted assemblies. The left support patch 9 and the right support patch 18 increase the stability and attachment integrity when the left weight body 8 and the right weight body 17 are respectively attached to the pair of clothing bottoms 1. The left leg portion 2 and the right leg portion 3 each comprise an outer lateral surface 4. The left support patch 9 is attached onto the outer lateral surface 4 of the left leg portion 2. In more detail, the left support patch 9 can be secured to or detached from the outer lateral surface 4 of left leg portion 2 when desired. The left weight body 8 is attached onto the left support patch 9, opposite the lateral surface of the left leg portion 2. In more detail, the left weight body 8 can be secured to or detached from the left support patch 9 when desired. Further, the left weight body 8 is secured to the left support patch 9 in order to increase the load to the left hip side of the user. Similarly, the right support patch 18 is attached onto the outer lateral surface 4 of the right leg portion 3. In more detail, the right support patch 18 can be secured to or detached from the outer lateral surface 4 of right leg portion 3 when desired. The right weight body 17 is attached onto the right support patch 18, opposite the lateral surface of the right leg portion 3. In more detail, the right weight body 17 can be secured to or detached from the right support patch 18 when desired. Further, the right weight body 17 is secured to the right support patch 18 in order to increase the load to the right hip side of the user.

Figure 5:
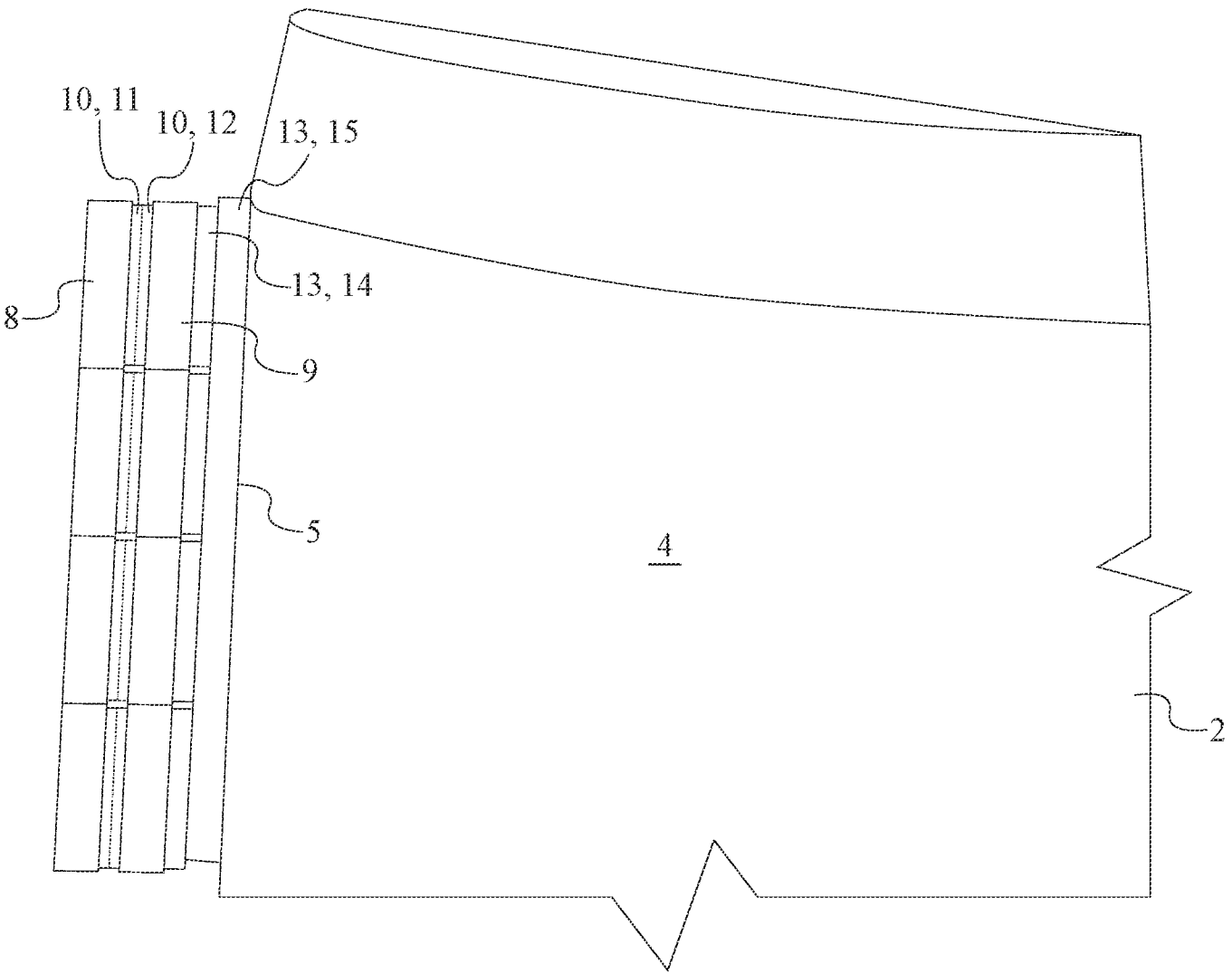
FIG. 5 is a schematic view displaying the left distal attachment mechanism and the left proximal attachment mechanism.

In order for the left weight body 8 to be effectively attached to the left support patch 9 and with reference to FIG. 5, the at least one left weight assembly 7 may further comprise a left distal attachment mechanism 10. The left distal attachment mechanism 10 may any type of attachment mechanism such as, but not limited to, a belt and buckle attachment mechanism, a magnet attachment mechanism, or a hook-and-loop attachment mechanism. However, in the preferred embodiment, the left distal attachment mechanism is a hook-and-loop fastener. The left distal attachment mechanism 10 comprises a first left distal interlocking piece 11 and a second left distal interlocking piece 12. Preferably, the first left distal interlocking piece 11 is a hooks portion of the hook-and-loop fastener, and the second left distal interlocking piece 12 is a loops portion of the hook-and-loop fastener. Alternatively, the first left distal interlocking piece 11 is the loops portion of the hook-and-loop fastener, and the second left distal interlocking piece 12 is the hooks portion of the hook-and-loop fastener. The first left distal interlocking piece 11 is mounted onto the left weight body 8. In more detail, the first left distal interlocking piece 11 is adhered onto the pouch of the left weight body 8 that holds the plurality of weighted beads. The second left distal interlocking piece 12 is connected onto the left support patch 9, opposite the outer lateral surface 4 of the left leg portion 2. In more detail, the second left distal interlocking piece 12 is adhered to the left support patch 9 on the side that does not contact the left leg portion 2. Further, the first left distal interlocking piece 11 and the second left distal interlocking piece 12 are engaged to each other. Thus, the left weight body 8 is effectively attached to the left support patch 9.

In order for the left support patch 9 to be effectively attached to the pair of clothing bottoms 1 and with reference to FIG. 5, the present invention may further comprise a left proximal attachment mechanism 13. The left proximal attachment mechanism 13 may any type of attachment mechanism such as, but not limited to, a belt and buckle attachment mechanism, a magnet attachment mechanism, or a hook-and-loop attachment mechanism. However, in the preferred embodiment, the left proximal attachment mechanism 13 is a hook-and-loop fastener. The left proximal attachment mechanism 13 comprises at least one left proximal interlocking piece 14 and a left proximal interlocking strip 15. Preferably, the at least one left proximal interlocking piece 14 is a hooks portion of the hook-and-loop fastener, and the left proximal interlocking strip 15 is a loops portion of the hook-and-loop fastener. Alternatively, the at least one left proximal interlocking piece 14 is the loops portion of the hook-and-loop fastener, and the left proximal interlocking strip 15 is the hooks portion of the hook-and-loop fastener. The at least one left proximal interlocking piece 14 is mounted onto the left support patch 9, opposite the left weight body 8. In more detail, the at least one left proximal interlocking piece 14 is adhered onto the left support patch 9 on the side that contacts the left leg portion 2. The left proximal interlocking strip 15 is connected along the outer lateral surface 4 of the left leg portion 2, opposite the right leg portion 3. In more detail, the left proximal interlocking strip 15 is sewn onto the outer lateral surface 4 of the left leg portion 2 that covers the left hip and the left thigh of the user. Further, the at least one left proximal interlocking piece 14 is engaged onto the left proximal interlocking strip 15. Thus, the left support patch 9 is effectively attached to the pair of clothing bottoms 1.

Figure 6:
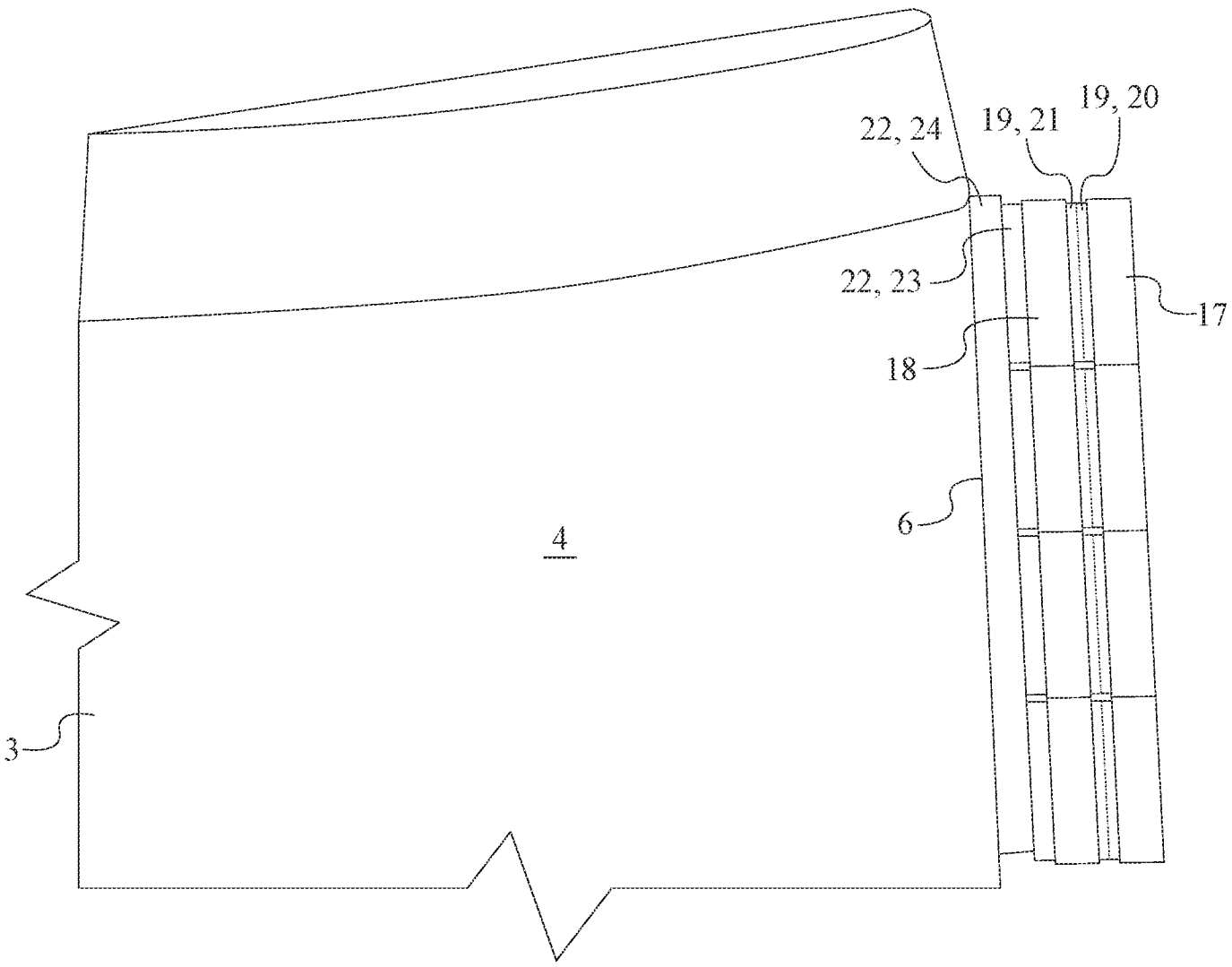
FIG. 6 is a schematic view displaying the right distal attachment mechanism and the right proximal attachment mechanism.

Similarly to the arrangement between the left weight body 8 and the left support patch 9, in order for the right weight body 17 to be effectively attached to the right support patch 18 and with reference to FIG. 6, the at least one right weight assembly 16 may further comprise a right distal attachment mechanism 19. The right distal attachment mechanism 19 may any type of attachment mechanism such as, but not limited to, a belt and buckle attachment mechanism, a magnet attachment mechanism, or a hook-and-loop attachment mechanism. However, in the preferred embodiment, the right distal attachment mechanism 19 is a hook-and-loop fastener. The right distal attachment mechanism 19 comprises a first right distal interlocking piece 20 and a second right distal interlocking piece 21. Preferably, the first right distal interlocking piece 20 is a hooks portion of the hook-and-loop fastener, and the second right distal interlocking piece 21 is a loops portion of the hook-and-loop fastener. Alternatively, the first right distal interlocking piece 20 is the loops portion of the hook-and-loop fastener, and the second right distal interlocking piece 21 is the hooks portion of the hook-and-loop fastener. The first right distal interlocking piece 20 is mounted onto the right weight body 17. In more detail, the first right distal interlocking piece 20 is adhered onto the pouch of the right weight body 17 that holds the plurality of weighted beads. The second right distal interlocking piece 21 is connected onto the right support patch 18, opposite the outer lateral surface 4 of the right leg portion 3. In more detail, the second right distal interlocking piece 21 is adhered to the right support patch 18 on the side that does not contact the right leg portion 3. Further, the first right distal interlocking piece 20 and the second right distal interlocking piece 21 are engaged to each other. Thus, the right weight body 17 is effectively attached to the right support patch 18.

Similarly to the arrangement between the left support patch 9 and the pair of clothing bottoms 1, in order for the right support patch 18 to be effectively attached to the pair of clothing bottoms 1 and with reference to FIG. 6, the present invention may further comprise a right proximal attachment mechanism 22. The right proximal attachment mechanism 22 may any type of attachment mechanism such as, but not limited to, a belt and buckle attachment mechanism, a magnet attachment mechanism, or a hook-and-loop attachment mechanism. However, in the preferred embodiment, the right proximal attachment mechanism 22 is a hook-and-loop fastener. The right proximal attachment mechanism 22 comprises at least one right proximal interlocking piece 23 and a right proximal interlocking strip 24. Preferably, the at least one right proximal interlocking piece 23 is a hooks portion of the hook-and-loop fastener, and the right proximal interlocking strip 24 is a loops portion of the hook-and-loop fastener. Alternatively, the at least one right proximal interlocking piece 23 is the loops portion of the hook-and-loop fastener, and the right proximal interlocking strip 24 is the hooks portion of the hook-and-loop fastener. The at least one right proximal interlocking piece 23 is mounted onto the right support patch 18, opposite the right weight body 17. In more detail, the at least one right proximal interlocking piece 23 is adhered onto the right support patch 18 on the side that contacts the right leg portion 3. The right proximal interlocking strip 24 is connected along the outer lateral surface 4 of the right leg portion 3, opposite the left leg portion 2. In more detail, the right proximal interlocking strip 24 is sewn onto the outer lateral surface 4 of the right leg portion 3 that covers the right hip and the right thigh of the user. Further, the at least one right proximal interlocking piece 17 is engaged onto the right proximal interlocking strip 24. Thus, the right support patch 18 is effectively attached to the pair of clothing bottoms 1.

Figure 3:
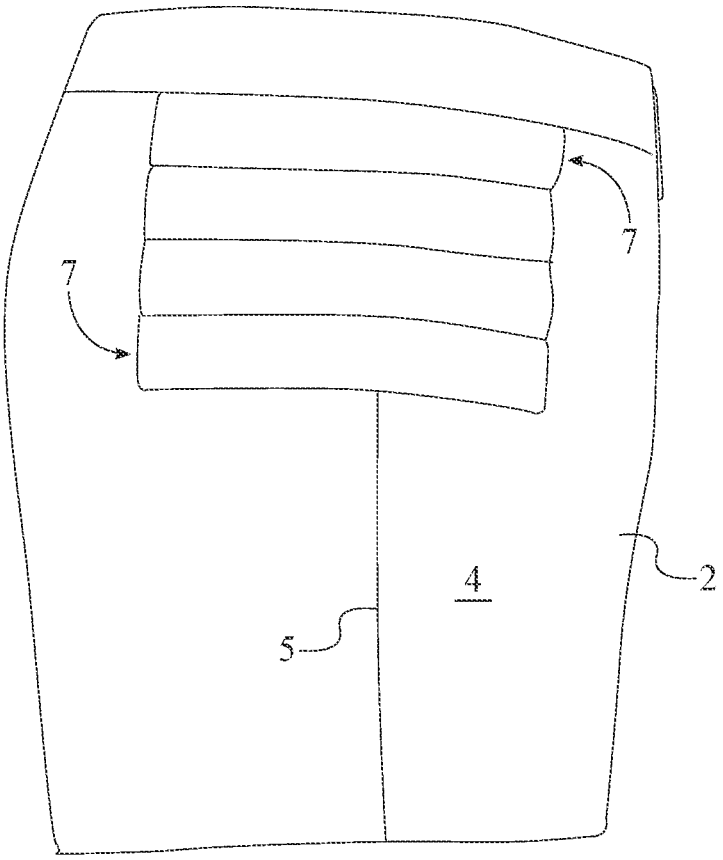
FIG. 3 is a left-side view of the present invention.

In order for multiple of the at least one left weight assembly 7 to be attached to the pair of clothing bottoms 1 and with reference to FIG. 3, the at least one left weight assembly 7 is a plurality of left weight assemblies 7. In this, case the plurality of left weight assemblies 7 is serially positioned along a left outseam 5 of the pair of clothing bottoms 1. This arrangement allows the load provided by plurality of left weight assemblies 7 to be evenly distributed along the left thigh of the user. In addition, as can be seen in FIGS. 1 through 3, the plurality of left weight assemblies 7 is positioned in between a waistband 25 of the pair of clothing bottoms 1 and a crotch point 26 of the pair of clothing bottoms 1 and is positioned adjacent to the waistband 25, offset from the crotch point 26. Similarly and with reference to FIG. 4, in order for multiple of the at least one right weight assembly 16 to be attached to the pair of clothing bottoms 1, the at least one right weight assembly 16 is a plurality of right weight assemblies 16. In this, case the plurality of right weight assemblies 16 is serially positioned along a right outseam 6 of the pair of clothing bottoms 1.

Figure 4:
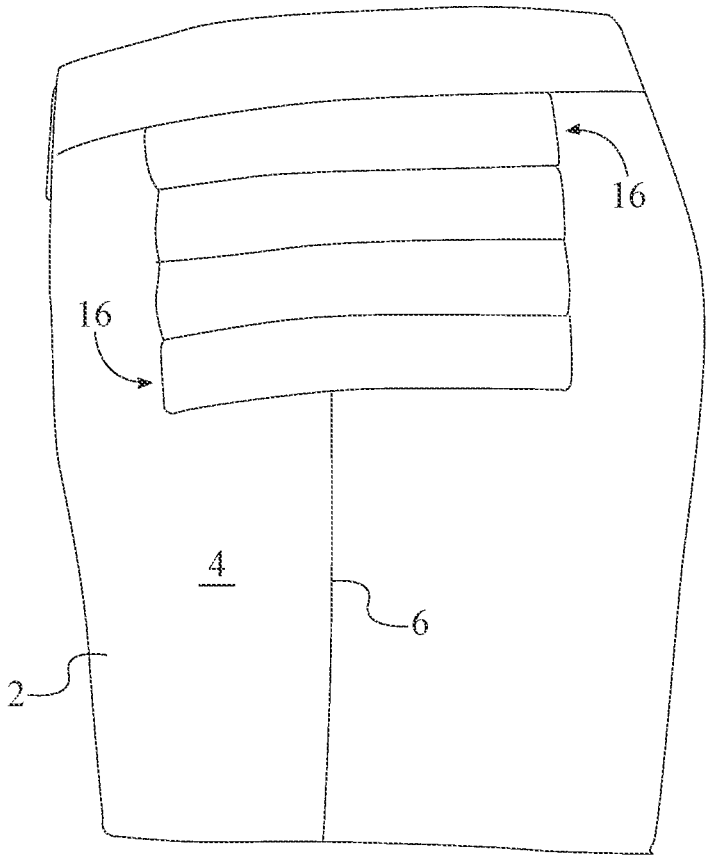
FIG. 4 is a right-side view of the present invention.

This arrangement allows the load provided by plurality of right weight assemblies 16 to be evenly distributed along the right thigh of the user. In addition, as can be seen in FIGS. 1, 2, and 4, the plurality of left weight assemblies 16 is positioned in between the waistband 25 and the crotch point 26 and is positioned adjacent to the waistband 25, offset from the crotch point 26.

Moreover, the pair of clothing bottoms 1 may further comprise an anterior portion 27 and a posterior portion 28, which can be used to define the left weight body 8 and the right weight body 17. The left weight body 8 is an elongated body comprising a left lateral body surface 33, a first left body end 29, and a second left body end 30, which are shown in FIGS. 1 through 3. The left weight body 8 is positioned about the left leg portion 2 and is positioned parallel to the waistband 25, which allows the first left body end 29 to be positioned on the anterior portion 27 and allows the second left body end 30 to be positioned on the posterior portion 28. In addition, the left lateral body surface 33 of an arbitrary left elongated weight body is pressed against and along the left lateral body surface 33 of an adjacent left elongated weight body, wherein the arbitrary left elongated weight body and the adjacent left elongated weight body are any two consecutive left elongated weight bodies from the plurality of left elongated weight bodies 7. Similarly, the right weight body 17 is an elongated body comprising a right lateral body surface 34, a first right body end 31, and a second right body end 32, which are shown in FIGS. 1, 2, and 4. The right weight body 17 is positioned about the right leg portion 3 and is positioned parallel to the waistband 25, which allows the first right body end 31 to be positioned on the anterior portion 27 and allows the second right body end 32 to be positioned on the posterior portion 32. In addition, the right lateral body surface 34 of an arbitrary right elongated weight body is pressed against and along the right lateral body surface 34 of an adjacent right elongated weight body, wherein the arbitrary right elongated weight body and the adjacent right elongated weight body are any two consecutive right elongated weight bodies from the plurality of right elongated weight bodies 16.

Although the invention has been explained in relation to its preferred embodiment, it is to be understood that many other possible modifications and variations can be made without departing from the spirit and scope of the invention as hereinafter claimed.

What is claimed is:

1. A pair of clothing bottoms with attachable weights comprising:

a pair of clothing bottoms;

a plurality of left weight assemblies;

a plurality of right weight assemblies;

the pair of clothing bottoms comprising a left leg portion, a right leg portion, a left outseam, a right outseam, a waistband, a crotch point, an anterior portion, and a posterior portion;

each of the plurality of left weight assemblies comprising a left elongated weight body, a left support patch, and a left distal attachment mechanism;

each of the plurality of right weight assemblies comprising a right elongated weight body, a right support patch, and a right distal attachment mechanism;

the left leg portion and the right leg portion each comprising an outer lateral surface;

the left elongated weight body comprising a left lateral body surface, a first left body end, and a second left body end;

the left distal attachment mechanism comprising a first left distal interlocking piece having a left first distal interlocking piece surface and a second left distal interlocking piece;

the right elongated weight body comprising a right lateral body surface, a first right body end, and a second right body end;

the right distal attachment mechanism comprising a first right distal interlocking piece having a right first distal interlocking piece surface and a second right distal interlocking piece;

the left support patch being attached onto the outer lateral surface of the left leg portion;

the left elongated weight body being attached onto the left support patch, opposite the outer lateral surface of the left leg portion;

the right support patch being attached onto the outer lateral surface of the right leg portion;

the right elongated weight body being attached onto the right support patch, opposite the outer lateral surface of the right leg portion;

the plurality of left weight assemblies being serially positioned along the left outseam;

the plurality of left weight assemblies being positioned in between the waistband and the crotch point;

the plurality of left weight assemblies being positioned adjacent to the waistband, offset from the crotch point;

the left elongated weight body being positioned about the left leg portion;

the left elongated weight body being perpendicularly bisected by the left outseam;

the left elongated weight body of each of the plurality of left weight assemblies being arranged as a series of parallel elongated bodies;

the left lateral body surface of an arbitrary left weight assembly being pressed against and along the left lateral body surface of an adjacent left weight assembly and the left first distal interlocking piece surface of the arbitrary left weight assembly being pressed against and along the left first distal interlocking piece surface of the adjacent left weight assembly, wherein the arbitrary left weight assembly and the adjacent left weight assembly are any two consecutive left weight assemblies from the plurality of left weight assemblies;

the first left body end being positioned on the anterior portion;

the second left body end being positioned on the posterior portion;

the plurality of right weight assemblies being serially positioned along the right outseam;

the plurality of right weight assemblies being positioned in between the waistband and the crotch point;

the plurality of right weight assemblies being positioned adjacent to the waistband, offset from the crotch point;

the right elongated weight body being positioned about the right leg portion;

the right elongated weight body being perpendicularly bisected by the right outseam;

the right elongated weight body of each of the plurality of right weight assemblies being arranged as another series of parallel elongated bodies;

the right lateral body surface of an arbitrary right weight assembly being pressed against and along the right lateral body surface of an adjacent right weight assembly and the right first distal interlocking piece surface of the arbitrary right weight assembly being pressed against and along the right first distal interlocking piece surface of the adjacent right weight assembly, wherein the arbitrary right weight assembly and the adjacent right weight assembly are any two consecutive right weight assemblies from the plurality of right weight assemblies;

the first right body end being positioned on the anterior portion;

the second right body end being positioned on the posterior portion;

the first left distal interlocking piece being mounted onto the left elongated weight body;

the second left distal interlocking piece being connected onto the left support patch, opposite the outer lateral surface of the left leg portion;

the first left distal interlocking piece and the second left distal interlocking piece being engaged to each other;

the first right distal interlocking piece being mounted onto the right elongated weight body;

the second right distal interlocking piece being connected onto the right support patch, opposite the outer lateral surface of the right leg portion; and the first right distal interlocking piece and the second right distal interlocking piece being engaged to each other.

2. The pair of clothing bottoms with attachable weights as claimed in claim 1, wherein the left distal attachment mechanism is a hook-and-loop fastener, and wherein the first left distal interlocking piece is a hooks portion of the hook-and-loop fastener, and wherein the second left distal interlocking piece is a loops portion of the hook-and-loop fastener.

3. The pair of clothing bottoms with attachable weights as claimed in claim 1, wherein the left distal attachment mechanism is a hook-and-loop fastener, and wherein the first left distal interlocking piece is a loops portion of the hook-and-loop fastener, and wherein the second left distal interlocking piece is a hooks portion of the hook-and-loop fastener.

4. The pair of clothing bottoms with attachable weights as claimed in claim 1 comprising:

a left proximal attachment mechanism;

the left proximal attachment mechanism comprising at least one left proximal interlocking piece and a left proximal interlocking strip;

the at least one left proximal interlocking piece being connected onto the left support patch, opposite the left elongated weight body;

the left proximal interlocking strip being connected along the outer lateral surface of the left leg portion, opposite to the right leg portion; and the at least one left proximal interlocking piece being engaged onto the left proximal interlocking strip.

5. The pair of clothing bottoms with attachable weights as claimed in claim 4, wherein the left proximal attachment mechanism is a hook-and-loop fastener, and wherein the left proximal interlocking piece is a hooks portion of the hook-and-loop fastener, and wherein the left proximal interlocking strip is a loops portion of the hook-and-loop fastener.

6. The pair of clothing bottoms with attachable weights as claimed in claim 4, wherein the left proximal attachment mechanism is a hook-and-loop fastener, and wherein the left proximal interlocking piece is a loops portion of the hook-and-loop fastener, and wherein the left proximal interlocking strip is a hooks portion of the hook-and-loop fastener.

7. The pair of clothing bottoms with attachable weights as claimed in claim 1, wherein the right distal attachment mechanism is a hook-and-loop fastener, and wherein the first right distal interlocking piece is a hooks portion of the hook-and-loop fastener, and wherein the second right distal interlocking piece is a loops portion of the hook-and-loop fastener.

8. The pair of clothing bottoms with attachable weights as claimed in claim 1, wherein the right distal attachment mechanism is a hook-and-loop fastener, and wherein the first right distal interlocking piece is a loops portion of the hook-and-loop fastener, and wherein the second right distal interlocking piece is a hooks portion of the hook-and-loop fastener.

9. The pair of clothing bottoms with attachable weights as claimed in claim 1 comprising:

a right proximal attachment mechanism;

the right proximal attachment mechanism comprising at least one right proximal interlocking piece and a right proximal interlocking strip;

the at least one right proximal interlocking piece being connected onto the right support patch, opposite the right elongated weight body;

the right proximal interlocking strip being connected along the outer lateral surface of the right leg portion, opposite to the left leg portion; and the at least one right proximal interlocking piece being engaged onto the right proximal interlocking strip.

10. The pair of clothing bottoms with attachable weights as claimed in claim 9, wherein the right proximal attachment mechanism is a hook-and-loop fastener, and wherein the right proximal interlocking piece is a hooks portion of the hook-and-loop fastener, and wherein the right proximal interlocking strip is a loops portion of the hook-and-loop fastener.

11. The pair of clothing bottoms with attachable weights as claimed in claim 9, wherein the right proximal attachment mechanism is a hook-and-loop fastener, and wherein the right proximal interlocking piece is a loops portion of the hook-and-loop fastener, and wherein the right proximal interlocking strip is a hooks portion of the hook-and-loop fastener.

* * * * *